US005372098A

United States Patent [19]

Borsboom et al.

[11] Patent Number: 5,372,098

[45] Date of Patent: Dec. 13, 1994

[54] INTEGRATED COOLING SYSTEM

[75] Inventors: Wouter A. Borsboom, Leidschendam; Cornelis H. Honselaar, Arnhem, both of Netherlands

[73] Assignee: DSM N.V., Heerlen, Netherlands

[21] Appl. No.: 97,750

[22] Filed: Jul. 28, 1993

[30] Foreign Application Priority Data

Jul. 30, 1992 [NL] Netherlands ..... 9201377

[51] Int. Cl.[5] ..... F01P 5/10

[52] U.S. Cl. ..... 123/41.44; 123/41.01; 165/120

[58] Field of Search ..... 123/41.44, 198 C, 41.01, 123/41.02, 41.55; 165/120, 51

[56] References Cited

U.S. PATENT DOCUMENTS

| | | | |
|---|---|---|---|
| 1,284,177 | 11/1918 | Camden | 123/41.44 |
| 1,691,614 | 11/1928 | Rushmore | 123/41.45 |
| 2,286,398 | 6/1942 | Young | 165/51 |
| 2,420,436 | 5/1947 | Mallory | 123/41.02 |
| 3,096,818 | 7/1963 | Evans et al. | 165/51 |
| 4,156,408 | 5/1979 | Protze | 123/41.51 |
| 5,002,019 | 3/1991 | Klaucke et al. | 123/41.49 |
| 5,036,803 | 8/1991 | Nolting et al. | 123/41.1 |
| 5,079,488 | 1/1992 | Harms et al. | 123/41.44 |

FOREIGN PATENT DOCUMENTS

| | | |
|---|---|---|
| 2347534 | 11/1977 | France . |
| 8904419 | 5/1989 | WIPO . |

*Primary Examiner*—Noah P. Kamen
*Attorney, Agent, or Firm*—Cushman, Darby & Cushman

[57] ABSTRACT

Cooling system for a liquid-cooled combustion engine including a radiator having at least one inlet and one outlet, a coolant pump and at least a control valve for controlling the flow of coolant through the radiator depending on the coolant temperature. The coolant pump and the radiator are integrated into a single unit. The coolant pump is preferably integrated in a radiator end cover, into which the control valve may also be incorporated. Such an integrated end cover may be obtained by e.g. injection molding of a thermoplastic polymer, preferably a polyamide. The number of hose connections is greatly reduced by the integration.

9 Claims, 7 Drawing Sheets

INTEGRATED COOLING SYSTEM

BACKGROUND OF THE INVENTION

The invention relates to a cooling system for a liquid-cooled combustion engine having at least a radiator with at least one inlet and one outlet, at least one coolant pump and at least one device, hereafter referred to as control valve, for controlling the flow of coolant through the radiator depending, if so desired, on the coolant temperature.

Such a cooling system is applied on a large scale especially on combustion engines in motor vehicles. The operating principle of such a cooling system generally is as follows: (see FIG. 1). When the combustion engine is running, heat is generated. This heat is carried off by a coolant circulating through the wall of the combustion engine. The coolant is circulated by a coolant pump (2). To allow rapid warm-up of the engine, the coolant circuit is divided into two loops which may be interconnected by means of one or more control valves (3). In a first loop, (10), (11) and (12) the coolant circulates through the cylinder block only. The second loop (13 and 14) is opened only when the coolant temperature exceeds a predetermined value. The second loop passes coolant through the radiator 7 and is opened by means of control valve (3) so that the heat generated can be carried off through the radiator (4). The radiator is made up of a heat exchanger (5) and end covers (6) and (7). Generally, the radiator is a heat exchanger of the liquid/air type situated at some distance from the engine, with the heat generated being swept away by the air through which the vehicle moves or by a forced air flow produced by a fan.

The coolant circulation pump (2) is usually mounted on the engine and is driven by the crankshaft of the combustion engine by means of, for instance, a V-belt, timing chain or a train of gears. This pump arrangement is advantageous in that use may be made of the mechanical energy generated in the combustion engine. It has a disadvantage, however, in that the pump operates only when the engine is running and that the pump capacity varies with the speed of the engine. A further disadvantage is that, being directly mounted on the engine, the pump must be capable of withstanding high temperatures and, for that reason, must be made of metal and the seals must meet stringent requirements. These factors increase cost. The same applies to the control valve.

SUMMARY OF THE INVENTION

In order to eliminate these objections, a liquid cooling system for a liquid-cooled combustion engine is provided which includes at least one radiator with at least one inlet and one outlet; a coolant pump; and a control valve for controlling the flow of coolant through the radiator depending on the coolant temperature. The coolant pump and the radiator are integrated into a single unit.

Preferably, the coolant pump is combined with a radiator end cover to form one assembly. The radiator end cover generally is a cover-like body, which, on the open side, is fixed to at least one inlet and/or outlet of the heat exchanger and serves to distribute the coolant to the cooling passages of the heat exchanger and to seal the heat exchanger. Generally, the radiator cover is further provided with facilities for connecting coolant hoses, for filling the cooling circuit, for pressure relief etc., as well as for temperature measurement and with other desired provisions.

Such integral end cover forms part of the present invention.

It is known from, inter alia, U.S. Pat. No. 4,519,473, Finley at al. in SAE 1989 880263 and U.S. Pat. No. 4,156,407 to place a liquid coolant pump in the cooling circuit separate from the engine. However, the pump is by no means integrated here with the radiator.

A further advantage can be gained by also integrating the control valve in the radiator. Further, if desired, the electronic control of the cooling system can be integrated in the radiator. Thus, it is in principle possible to reduce the number of hose connections to two and to reduce the assembly effort and the likelihood of failures.

It is most advantageous to integrate the pump, the control valve and the radiator and to fabricate the same from a dimensionally stable and heat and hydrolysis resistant plastic composition. Such compositions are known, as is the application of a number of them for radiator end covers.

Highly suitable plastics are polyamides, notably aliphatic polyamides such as polyamide 4.6 and 6.6 and partially aromatic polyamides such as terephthalic acid-based and isophthalic acid-based polyamides. Such polyamides may be employed as a homopolymer, copolymer or mixtures thereof. Preferably, polyamide 4.6 and 6.6, optionally mixed or copolymerised with another polyamide, are applied.

The plastic composition preferably contains a reinforcing filler, for instance a fibrous material, preferably glass fibers and/or a mineral filler, for instance clay, glass beads, mica. Furthermore, the plastic may contain common additives such as hydrolysis stabilizers, heat stabilizers, colouring agents, pigments, impact strength improving agents, mould release agents and the like.

The coolant pump may be driven mechanically, for instance by a V-belt or flexible shaft coupled to the crankshaft of the combustion engine, or may be driven electrically. The pump is preferably driven by an electric motor for reasons of controllability of the system. However, a combination of mechanical and electrical propulsion may be most advantageous for optimum fuel consumption.

Control options and advantages of electrical drive systems for coolant pumps are described in, for instance, U.S. Pat. No. 4,156,407, DE-A-2656361 and FR-A-23S4106 U.S. Pat. No. 4,557,223.

Mechanical and electrical drive systems may in principle be combined in at least two ways: in the first place, by providing both an electrically driven pump and a mechanically driven pump, at least one of which, but preferably the electrically driven pump, being integrated in the radiator, and in the second place by a single pump with both an electrical drive and a mechanical drive. In that case, the electrical drive system may be utilized when the engine is stationary and may be electrically disengaged when the mechanical drive system is activated. When the engine is cut-off, the mechanical transmission from the crankshaft to the pump drive may be disengaged by means of, for instance, a freewheeling arrangement or another common means. This means of disengaging the mechanical transmission is preferably situated at the pump.

If the pump has a mechanical drive system, the position of the control valve may be controlled by common means.

If the pump drive is all-electrical, it is in principle possible also to design the cooling circuit without a control valve and to control the liquid circulation entirely by means of the speed of the pump drive as a function of temperature, without a by-pass circuit. Such a speed control is known from DE-A-2712438 and FR-A-2384106.) In that case, the cooling circuit may be of the simplest design.

DETAILED DESCRIPTION OF THE PRESENTLY PREFERRED EXEMPLARY EMBODIMENTS

Figure 1:
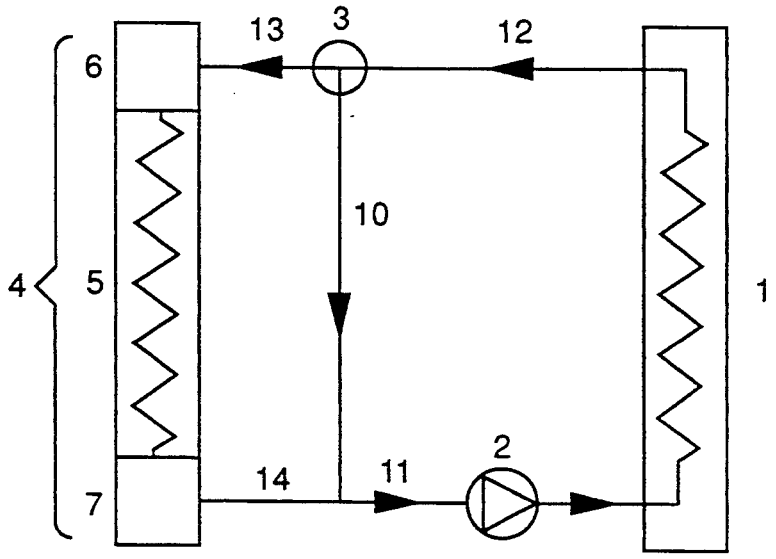
Fig. 1 (PRIOR ART)
FIG. 1 is a schematic diagram of a conventional cooling system showing a separate pump, control valve and radiator.

A conventional cooling system is schematically shown in FIG. 1, i.e. the pump and the control valve are not integrated in the radiator. Liquid coolant is circulated through the engine (1) by pump (2). The control valve (3) either returns the liquid flow to the engine or directs it in whole or part to the radiator (4) where, in heat exchanger (5), cooling is effected by the air in which the vehicle moves or by a forced air flow. The liquid inlet and the liquid outlet of the radiator are located on the radiator end covers (6) and (7).

If the inlet and outlet are positioned on one and the same end cover, the heat exchanger and the end cover in question are separated by a partition.

The cooling system is further provided with common provisions for filling with liquid coolant and for absorbing expansion of the coolant and for discharging gas bubbles. These provisions, which do not in themselves form part of the invention, are not shown in the figures. Nor are temperature sensors and electronic control circuitry for the control valve shown. In the cooling circuit described above at least 5 hose connections (10) to (14) are needed between the various components of the cooling system.

Figure 2:
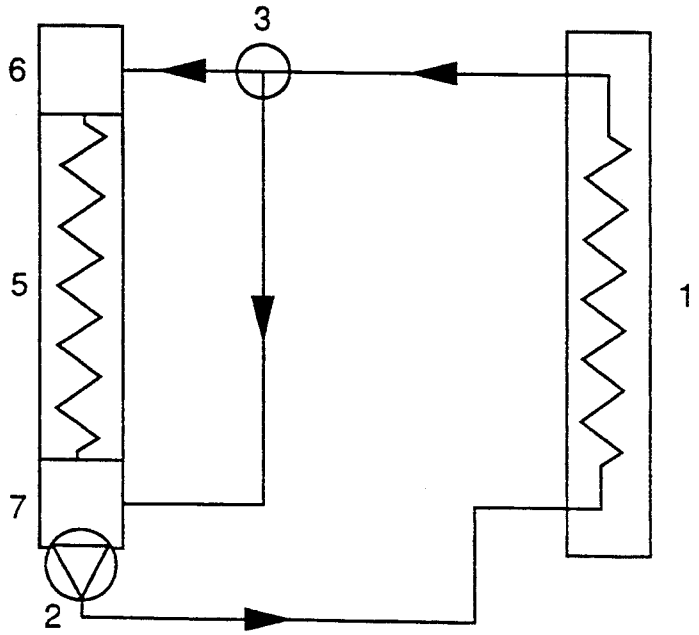
FIG. 2 is a schematic diagram of a cooling system provided in accordance with the principles of the present invention.

The invention is elucidated by a number of embodiments, schematic representations of which are given in FIGS. 2–4.

Figure 3A:
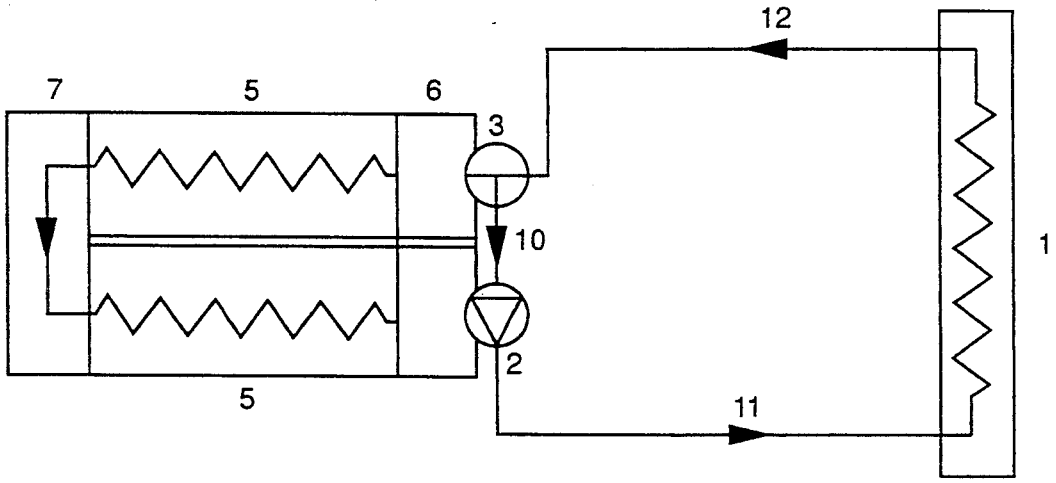
FIG. 3*a*–3*b* are schematic diagrams of a second embodiment of the cooling system of the invention showing a control valve and a pump integrated in an end cover.
Figure 3B:
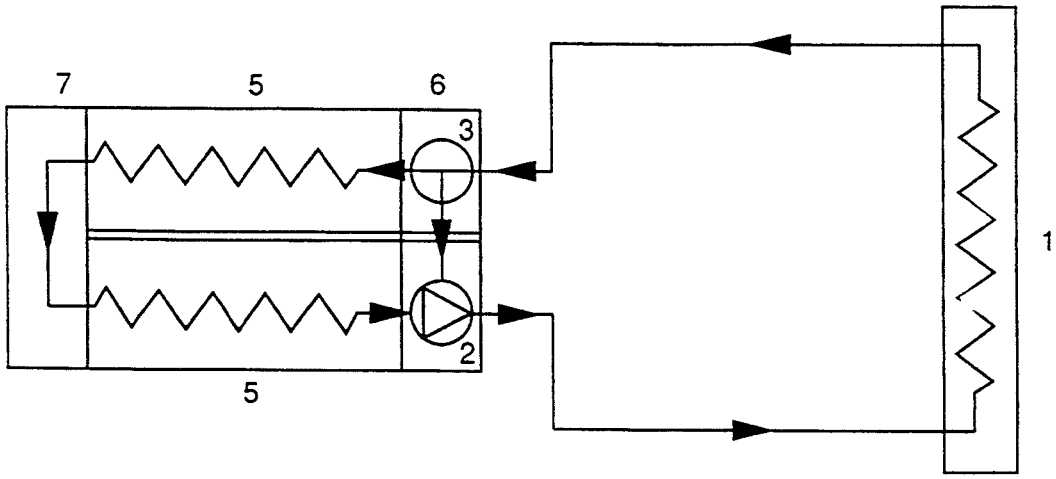

In FIG. 2, the pump is integrated in a radiator end cover. FIGS. 3*a* and 3*b* are a schematic representation of the situation where both the control valve and the pump are integrated in an end cover. Because of this far-reaching integration only two hose connections (11) and (12) remain in FIG. 3*b*. The by-pass line (10) and the lines (13) and (14) are fully incorporated in the integrated end cover.

Figure 4A:
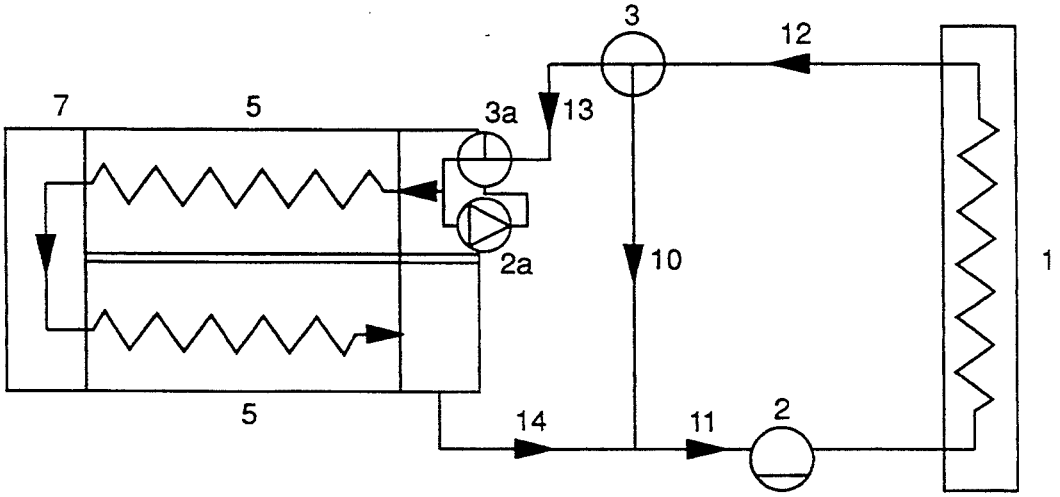
FIGS. 4*a* and 4*b* are schematic diagrams of a third embodiment of the invention.

FIGS. 4*a* and *b* are a schematic representation of the situation where the conventional cooling system in FIG. 1 is extended by an electrically driven pump (2*a*) integrated with the radiator; an extra control valve (3*a*) is integrated with the radiator also.

Figure 4B:
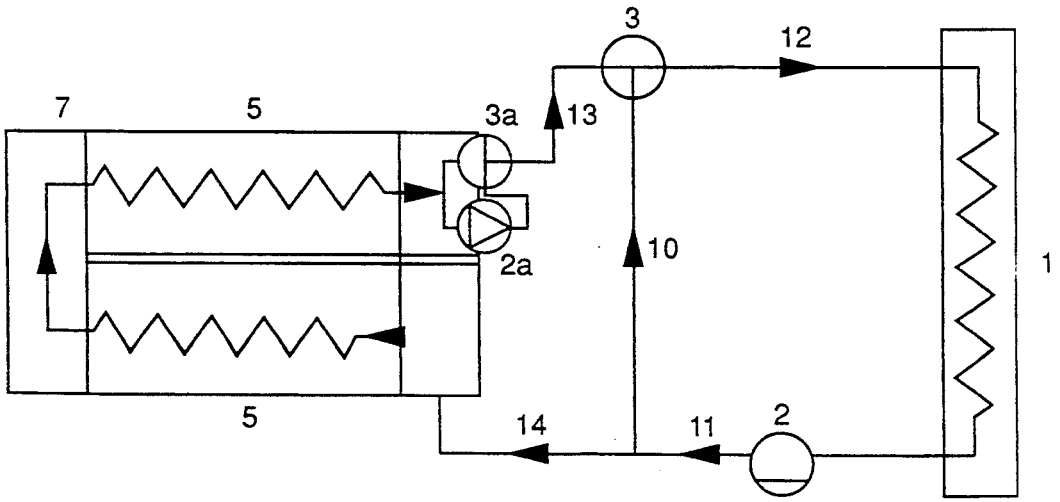
Figure 5:
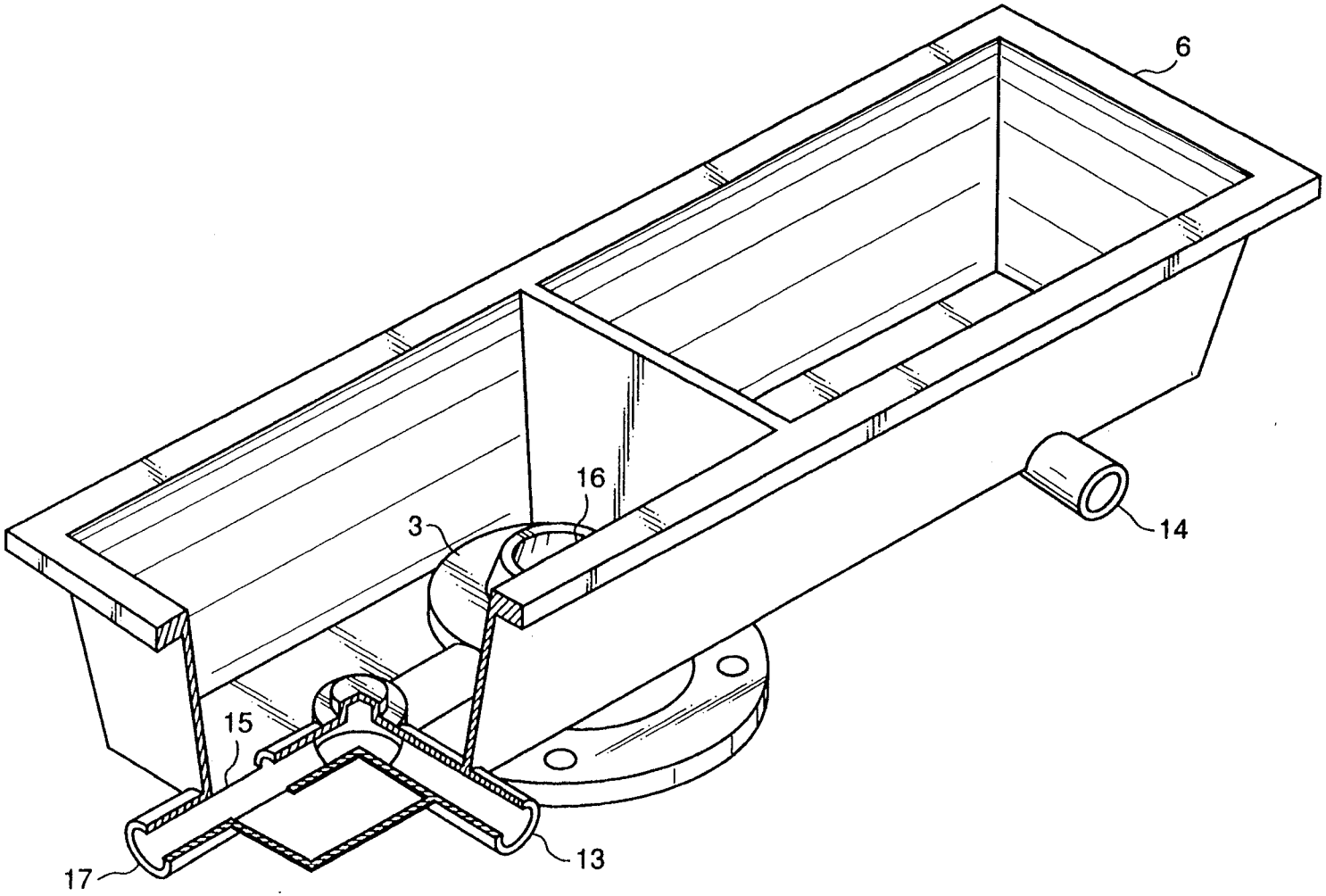
FIG. 5 is a perspective view of an end cover provided in accordance with the principles of the present invention, shown with a corner portion removed for clarity of illustration.
Figure 6:
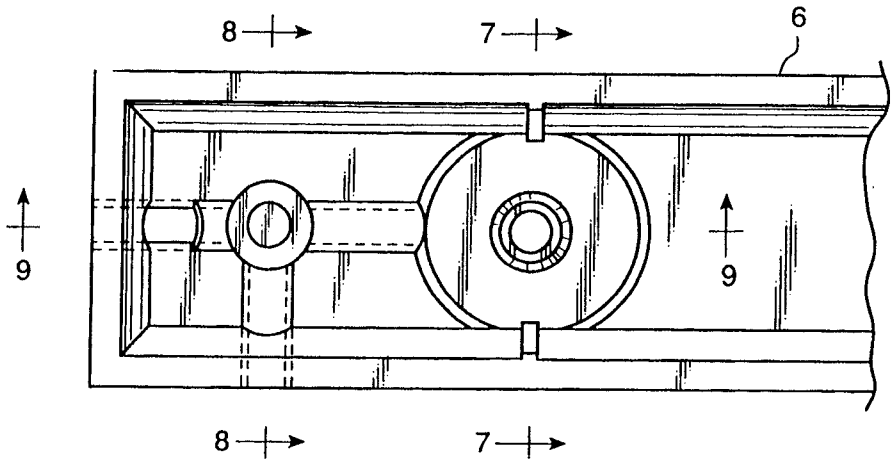
FIG. 6 is a plan view of a portion of the end cover of FIG. 5.
Figure 9:
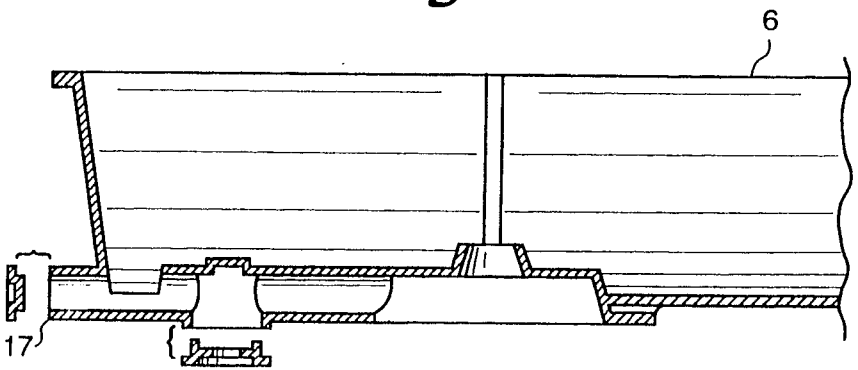
FIG. 9 is a cross-sectional view taken along the line 9—9 of FIG. 6.
Figure 7:
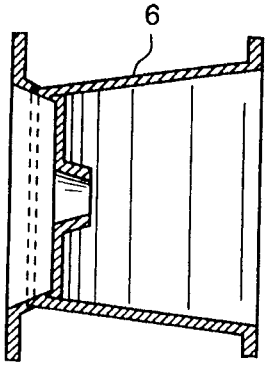
FIG. 7 is a cross-sectional view taken along the line 7—7 of FIG. 6.
Figure 8:
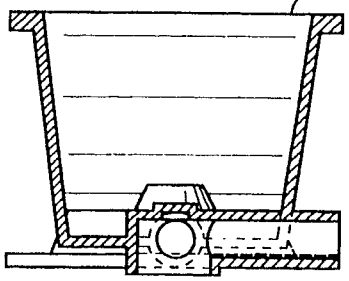
FIG. 8 is a cross-sectional view taken along the line 8—8 of FIG. 6.

FIG. 5 is a three-dimensional representation of an embodiment of such an end cover as shown schematically in FIGS. 4*a* and 4*b*. Sections are shown in FIGS. 6–9. The control valve 3*a* may be adjusted so that coolant from line 13 enters the first compartment of the end cover through opening 15 to leave the radiator by way of the heat exchanger through outlet 14. This arrangement operates when the electrically driven auxiliary pump 2*a* in the end cover is not running and the coolant is circulated by pump 2 (corresponding with the situation in FIG. 4*a*). When this pump 2 is not running and pump 2*a* is operating, the position of the control valve is such that opening 15 is shut-off, the coolant being drawn from the end cover by the centrifugal pump through line 16 and circulated through line 13 to return to the radiator through line 14 (corresponding with situation 4*b*). Line 17 is plugged-off.

Figure 10:
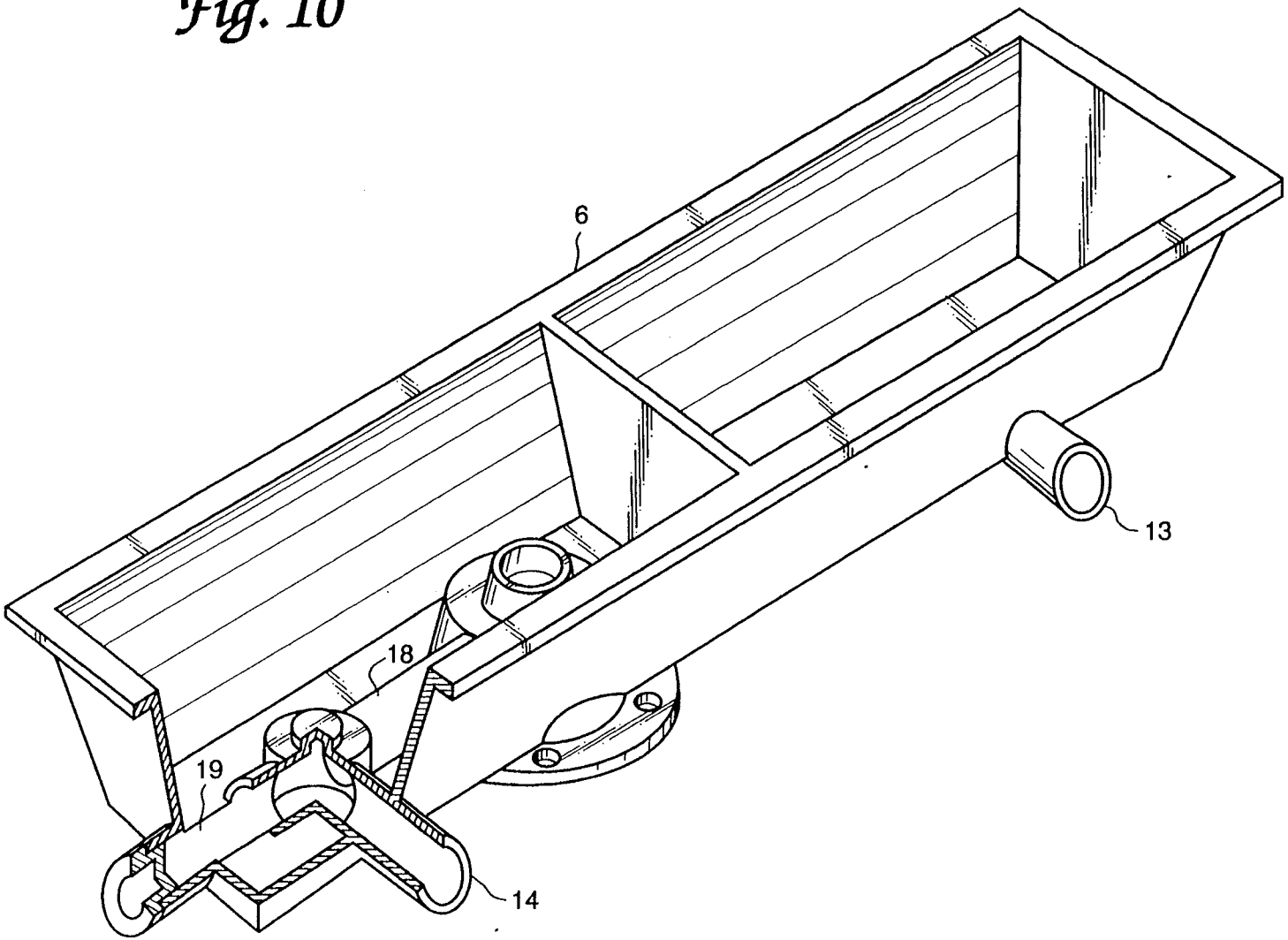
FIG. 10 is a perspective view of a variation of the end cover of FIG. 5 shown with a corner portion removed for clarity of illustration.
Figure 11:
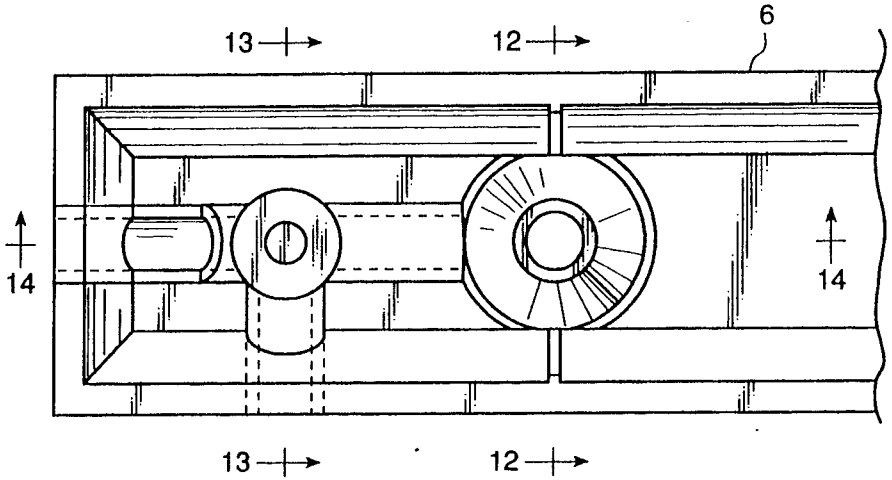
FIG. 11 is a plan view of a portion of the end cover of FIG. 10.
Figure 14:
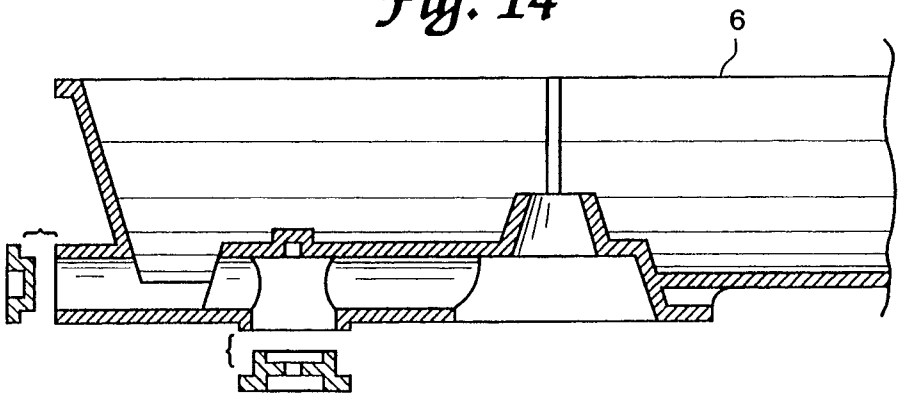
FIG. 14 is a cross-sectional view taken along the line 14—14 of FIG. 11.
Figure 12:
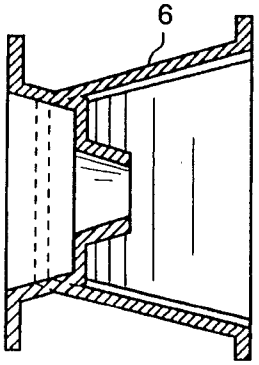
FIG. 12 is a cross-sectional view taken along the line 12—12 of FIG. 11.
Figure 13:
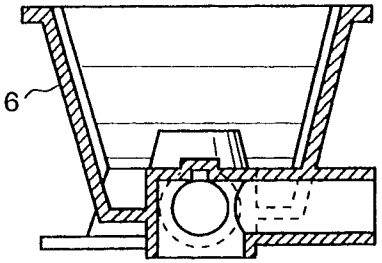
FIG. 13 is a cross-sectional view taken along the line 13—13 of FIG. 11.

It will be readily apparent from FIG. 5 how, for instance, the end cover in FIG. 3*b* may be configured. Thus, the control valve may be located in the other part of the end cover and may be connected to line (14). In FIG. 10, a line (18) from the control valve terminates in the first compartment of the end cover accommodating the centrifugal pump and the third line (19) from the control valve terminates in the part of the end cover which contains the control valve. The pump sucks in coolant either directly from line (14) via line (18) (by-pass situation) or from the heat exchanger via (19). The pump outlet connects to line (13). Sections of the end cover of FIG. 10 are shown in FIGS. 11–14.

Since the end cover with coolant inlet and outlet, the pump casing, and the control valve housing are produced in one and the same manufacturing operation, sealing problems are largely eliminated and assembly work is substantially reduced.

The integrated end cover of the invention may be manufactured by, for instance, injection moulding using, for instance, the meltable (,lost,) core technique or by injection moulding in two parts that are subsequently welded by, for instance, the ultrasonic technique.

It will be clear to one skilled in the art that various technical embodiments of the invention are possible depending on the vehicle designer's wishes and that the invention is not limited to the examples given.

We claim:

1. Cooling system for a liquid-cooled combustion engine comprising:

at least one radiator with at least one inlet and one outlet, said radiator being constructed and arranged to be cooled by air;

a coolant pump; and a control valve for controlling the flow of coolant through the radiator depending on the coolant temperature, wherein the coolant pump, the control valve and the radiator are integrated into a single unit.

2. Cooling system according to claim 1, wherein the control valve is controlled electronically.

3. Cooling system according to claim 1, wherein the coolant pump is driven by an electric motor.

4. A cooling system for a liquid-cooled combustion engine comprising:

a radiator having an end cover, said radiator being constructed and arranged to be cooled by air;

a coolant pump;

a control valve for controlling coolant through the radiator, said coolant pump and said control valve being integrated with said end cover.

5. Cooling system according to claim 4, further comprising a control valve for controlling the flow of coolant through the radiator.

6. Cooling system for a liquid-cooled combustion engine comprising:

at least one radiator having at least one inlet and one outlet;

a coolant pump; and means for controlling the flow of coolant through the radiator depending on the coolant temperature, wherein the coolant pump, the controlling means and the radiator are integrated into a single unit and said controlling means controls the speed of the coolant pump in response to the coolant temperature.

7. Cooling means according to claim 6, wherein said coolant pump is driven by an electric motor.

8. Cooling system according to claim 6, wherein the control valve is controlled electronically.

9. Cooling system for a liquid-cooled combustion engine comprising:

at least one radiator with at least one inlet and one outlet, said radiator including an end cover and being constructed and arranged to be cooled by air;

a coolant pump; and a control valve for controlling the flow of coolant through the radiator depending on the coolant temperature, wherein the coolant pump, the control valve and the end cover are integrated into a single unit.

* * * * *